US009415891B2

(12) United States Patent
Hermel

(10) Patent No.: US 9,415,891 B2
(45) Date of Patent: Aug. 16, 2016

(54) CONTAINER HAVING A BOTTOM PROVIDED WITH A STEPPED ARCH

(71) Applicant: SIDEL PARTICIPATIONS, Octeville sur Mer (FR)

(72) Inventor: Wilfried Hermel, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 0 days.

(21) Appl. No.: 14/403,667

(22) PCT Filed: May 15, 2013

(86) PCT No.: PCT/FR2013/051057

§ 371 (c)(1),
(2) Date: Nov. 25, 2014

(87) PCT Pub. No.: WO2013/178905

PCT Pub. Date: Dec. 5, 2013

(65) Prior Publication Data

US 2015/0136727 A1 May 21, 2015

(30) Foreign Application Priority Data

May 31, 2012 (FR) ..... 12 55049

(51) Int. Cl.
*B65D 1/02* (2006.01)
*B65D 1/46* (2006.01)

(52) U.S. Cl.
CPC ..... *B65D 1/0284* (2013.01); *B65D 1/46* (2013.01); *B65D 2501/0036* (2013.01)

(58) Field of Classification Search
CPC .. B65D 1/0207; B65D 1/2061; B65D 1/0276; B65D 1/0284; B65D 1/42; B65D 21/0231; B65D 79/005; B29B 2911/14693; B29B 2911/147; B29B 2911/14713; B29B 2911/14906; B29B 2911/14933
USPC ..... 215/373, 375, 377; 220/606, 608–609
See application file for complete search history.

(56) References Cited

U.S. PATENT DOCUMENTS 4,249,666 A * 2/1981 Hubert et al. ..... 215/373
4,620,639 A * 11/1986 Yoshino ..... B29C 49/0078 215/373

(Continued)

FOREIGN PATENT DOCUMENTS

EP 2 133 277 A1 12/2009
JP 58-067719 U 5/1983

(Continued)

OTHER PUBLICATIONS

International Search Report for PCT/FR2013/051057 dated Jul. 1, 2013 [PCT/ISA/210].

*Primary Examiner* — J. Gregory Pickett
*Assistant Examiner* — Brijesh V. Patel
(74) *Attorney, Agent, or Firm* — Sughrue Mion, PLLC

(57) ABSTRACT

A container made of plastic, provided with a body and with a bottom extending from an end of the body, the bottom having a peripheral seat defining a seating plane, a central zone at an inner area of the bottom surrounding a pellet and corresponding to a zone of injection of the material of a preform used to produce the container, a concave arch extending from the central zone to the peripheral seat, a series of principal reinforcing grooves extending radially from the central zone to at least the peripheral seat. The arch has two concentric regions, including a central region and a peripheral region, separated by a median axial step that extends annularly continuously around the central zone, so that the central region is raised with respect to the peripheral region.

11 Claims, 3 Drawing Sheets

(56) References Cited

U.S. PATENT DOCUMENTS

| | | | | |
|---|---|---|---|---|
| 4,892,205 | A * | 1/1990 | Powers et al. | 215/375 |
| RE35,140 | E * | 1/1996 | Powers, Jr. | 215/375 |
| 5,906,286 | A * | 5/1999 | Matsuno et al. | 215/375 |
| 6,176,382 | B1 * | 1/2001 | Bazlur Rashid | 215/373 |
| 6,276,546 | B1 * | 8/2001 | Davis et al. | 215/375 |
| 6,585,123 | B1 * | 7/2003 | Pedmo | B65D 1/0276 206/509 |
| 6,634,517 | B2 * | 10/2003 | Cheng et al. | 215/373 |
| 7,416,089 | B2 * | 8/2008 | Kraft et al. | 215/373 |
| 2001/0002662 | A1 * | 6/2001 | Rashid | 215/373 |
| 2004/0211746 | A1 * | 10/2004 | Trude | 215/374 |
| 2005/0199578 | A1 * | 9/2005 | Young et al. | 215/375 |
| 2008/0035601 | A1 * | 2/2008 | Derrien | 215/376 |
| 2008/0302758 | A1 * | 12/2008 | Mody et al. | 215/375 |
| 2009/0218308 | A1 * | 9/2009 | Bunel et al. | 215/373 |
| 2009/0263534 | A1 * | 10/2009 | Lesueur | 425/522 |
| 2009/0308835 | A1 * | 12/2009 | Boukobza | 215/370 |
| 2010/0072165 | A1 * | 3/2010 | Schau | 215/371 |
| 2010/0163513 | A1 * | 7/2010 | Pedmo | 215/370 |
| 2010/0219152 | A1 * | 9/2010 | Derrien et al. | 215/374 |
| 2011/0049083 | A1 * | 3/2011 | Scott et al. | 215/371 |
| 2012/0168401 | A1 * | 7/2012 | Tissmer et al. | 215/372 |
| 2013/0270214 | A1 * | 10/2013 | Huels et al. | 215/377 |

FOREIGN PATENT DOCUMENTS

| | | | |
|---|---|---|---|
| JP | 62-251335 | A | 11/1987 |
| JP | 2004-217266 | A | 8/2004 |

* cited by examiner

CONTAINER HAVING A BOTTOM PROVIDED WITH A STEPPED ARCH

CROSS-REFERENCE TO RELATED APPLICATIONS

This application is a National Stage entry of International Application PCT/FR2013/051057 filed May 5, 2015, which claims the benefit of French Application No. FR 12-55049 filed on May 31, 2012, in the French Patent Office, the disclosures of which are incorporated herein in their entirety by reference.

TECHNICAL FIELD

The invention relates to the manufacture of containers, particularly bottles or jars, obtained by blowing or stretch blowing from preforms made of plastic, such as polyethylene terephthalate (PET).

BACKGROUND

Manufacturing a container by blowing ordinarily consists of inserting, into a mold with the imprint of the container, a blank (a preform or an intermediate container obtained by pre-blowing a preform) previously heated to a temperature above the glass transition temperature of the material, and of injecting into the blank a fluid (particularly a gas such as air) under pressure. The blowing can be completed by a preliminary stretching of the blank by means of a sliding rod.

The dual molecular orientation that the material undergoes during blowing (axial and radial, respectively parallel and perpendicular to the general axis of the container) gives a certain structural rigidity to the container.

However, the reduction—dictated by the market—in the quantity of material used for the manufacture of containers leads manufacturers to resort to artifices of manufacturing or shape to rigidify their containers since the bi-orientation proves to be insufficient. The result is that two containers of equal weight do not necessarily have the same mechanical performance (strength, rigidity).

A well-known method of increasing the rigidity of the container is heat setting, which consists of heating the wall of the mold in order to increase the rate of crystallinity by means of heat. This method, illustrated by French patent FR 2,649,035 (Sidel) and its American equivalent U.S. Pat. No. 5,145,632, is used particularly for heat resistant (HR) applications in which the container is hot-filled.

However, because of its cost and the reduction in production rate it requires, this type of method generally cannot be used for ordinary applications such as flat water. For these applications, the structural rigidity of the bottom essentially depends on its shape. It is known to rigidify the bottom by means of radial grooves, see for example French patent FR 2,753,435 (Sidel). Such a bottom preserves its mechanical strength without reversing, as long as the volume and pressure conditions in the container are normal. However, when these conditions are extreme, the bottom tends to collapse or even reverse. Thus, when the container is stored in high heat, typically when it is stored on a pallet outdoors in full sun, the temperature of the contents can reach or exceed 50° C., and the increase in pressure caused by the expansion of the contents exceeds the threshold beyond which the bottom reverses. The container then becomes unstable, with the increased risk of collapse of the whole pallet. Similarly, when the container is stored in a cooler at temperatures at which the contents freeze, the expansion induced by the solidification causes the bottom to reverse, the container also becoming unstable.

In theory, it would be possible to form deep hollow reserves on the bottom (particularly a deep arch) that could increase the mechanical strength of the bottom. However, this artifice, although effective, requires both an increase in material, incompatible with the aforementioned lightening requirements, and a high blowing pressure, incompatible with energy-saving requirements, which on the contrary assume a decrease in the blowing pressure needed for forming the container. For example, the current specifications for forming bottles for flat water with a capacity of 0.5 liter ordinarily require a mass on the order of 10 g, for a blowing pressure on the order of 20 bars.

SUMMARY

A first objective is to improve the mechanical performance of the containers at equivalent blowability (i.e. the ability of the container to be formed by blowing).

A second objective is to propose a container for which the optimized shape of the bottom gives it a good compromise between blowability, lightness and rigidity.

A third objective is to propose a container, the bottom of which offers good resistance to reversal and which, under extreme conditions of pressure and/or internal volume, can remain stable.

To that end, a container made of plastic is proposed, provided with a body and a bottom extending from a lower end of the body, the bottom comprising a peripheral seat defining a seating plane, a concave arch which extends from a central zone to the seat and a series of reinforcing grooves that extend radially from the central zone to at least the seat, in which container the arch has two concentric regions, i.e. a central region and a peripheral region, separated by a median axial step which extends annularly continuously around the central zone so that the central region is raised with respect to the peripheral region.

As a result of said step, the bottom ensures the stability of the container, even under conditions of extreme pressure and/or volume.

Various additional characteristics can be provided, alone or in combination:

- the step has a diameter of between 40% and 60% of the diameter of the seating plane;
- the diameter of the step is about 50% of the diameter of the seating plane;
- the grooves extend radially beyond the seat;
- the bottom comprises a series of reinforcing intermediate grooves that extend locally over the seat;
- the step extends over a height of between 0.4 and 1.2 mm;
- the container has a capacity of 0.5 liter and the step extends over a height of between 0.4 and 1.2 mm, in particular about 0.5 mm;
- the container has a capacity of 1.5 liter and the step extends over a height of between 0.7 and 1.2 mm, in particular about 1 mm.

BRIEF DESCRIPTION OF THE DRAWINGS

Other objects and advantages of the invention will be seen from the following description of one embodiment, provided with reference to the appended drawings in which.

DETAILED DESCRIPTION

Figure 1:
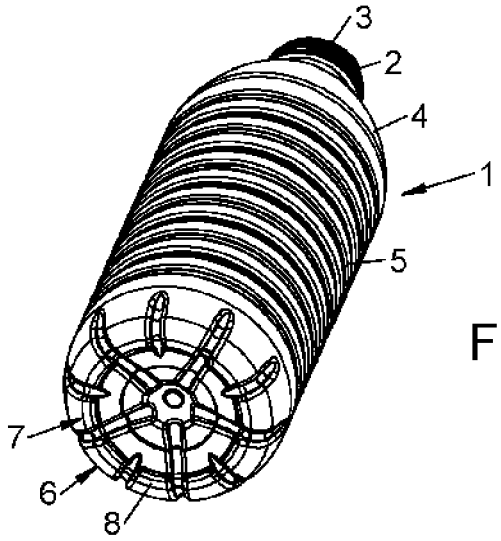
FIG. 1 is a view in perspective from below of a container made of plastic.

Represented in FIG. 1 is a container 1, a bottle in this instance, produced by stretch blowing a preform made of thermoplastic material, for example PET (polyethylene terephthalate).

Said container 1 comprises, at an upper end, a neck 2, provided with a mouth 3. In the extension of the neck 2, the container 1 comprises in its upper part a shoulder 4 that widens out in the direction opposite to the neck 2, said shoulder 4 being extended by a lateral wall or body 5, of a shape generally cylindrical in revolution around a principal axis X of the container 1.

The container 1 further comprises a bottom 6 which extends, opposite the neck 2, from a lower end of the body 5. The bottom 6 comprises a peripheral seat 7 in the form of an annular ridge which extends substantially axially in the extension of the body 5. The seat 7 terminates in a seating plane 8 perpendicular to the axis X of the container 1, said seating plane 8 defining the lower end of the container 1 and enabling it to be seated upright on a flat surface.

D1 denotes the diameter of the seating plane 8, the term "diameter" covering not only the case (illustrated) in which the container 1 (and thus the bottom 6) has a circular contour, but also a case in which the container 1 would have a polygonal contour (for example square), in which case the term "diameter" would designate the diameter of the circle in which said polygon is inscribed.

Towards the interior of the container 1, the seat 7 comprises an annular truncated cone-shaped cheek 9 that extends towards the interior of the container 1 in the extension of the seating plane 8, the cone frustum formed by the cheek 9 opening downwards (tapered) and having an angle at the top of at least 70°. Said cheek 9 can have a height of between 1 mm and 3 mm, for example about 1.5 mm.

The bottom 6 further comprises a concave arch 10, in the form of a substantially spherical dome with the concavity turned towards the exterior of the container 1 in the absence of stress, i.e. in the absence of contents in the container 1. The arch 10 extends from the seat 7, in the extension of the cheek 9, to a central zone 11 of the bottom 6 forming a boss projecting towards the interior of the container 1, with an amorphous pellet 12 at its center which corresponds to the zone of injection of the material of the preform used to produce the container and can serve as a centering function during the forming of the container 1 by blowing.

Figure 2:
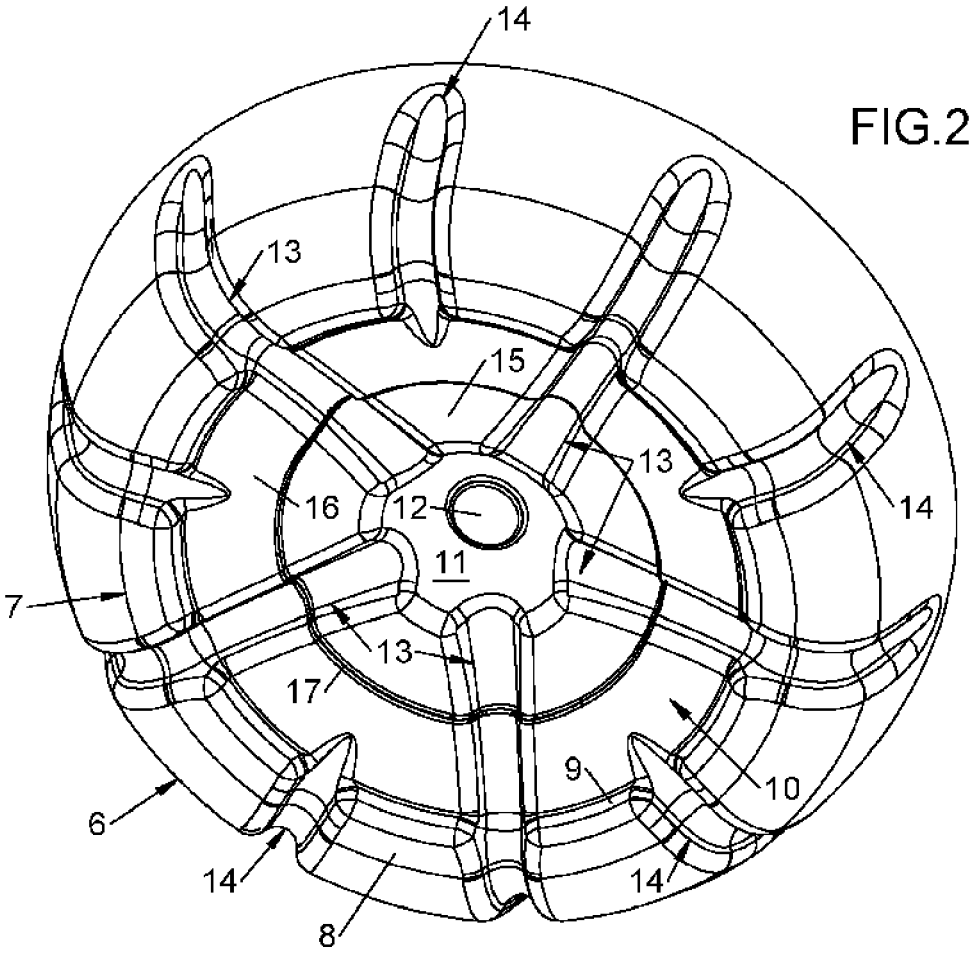
FIG. 2 is a view in perspective, in larger scale, showing the bottom of the container of FIG. 1.

As can be seen in the Figures, and particularly in FIG. 2, the bottom 6 comprises a series of principle reinforcing grooves 13 that are hollow towards the interior of the container 1, and which extend radially from a central zone 11 to at least the seat 7. According to a preferred embodiment, illustrated in the Figures, the principal reinforcing grooves 13 extend beyond the seat 7, rising laterally over a lower part of the body 5.

In other words, the principal grooves 13 extend radially over the entire arch 10, over the seat 7 and part of the body 5. It will therefore be understood that the seating plane 8 is discontinuous because it is interrupted at each principal groove 13. For example, there are five principle grooves 13 (as in the illustrated example, which corresponds to a container with a capacity of 0.5 liter), but this number could be higher, specifically six for a container with a capacity equal to or greater than 1 liter, or seven for a container with a capacity of 2.5 liters or more.

Figure 3:
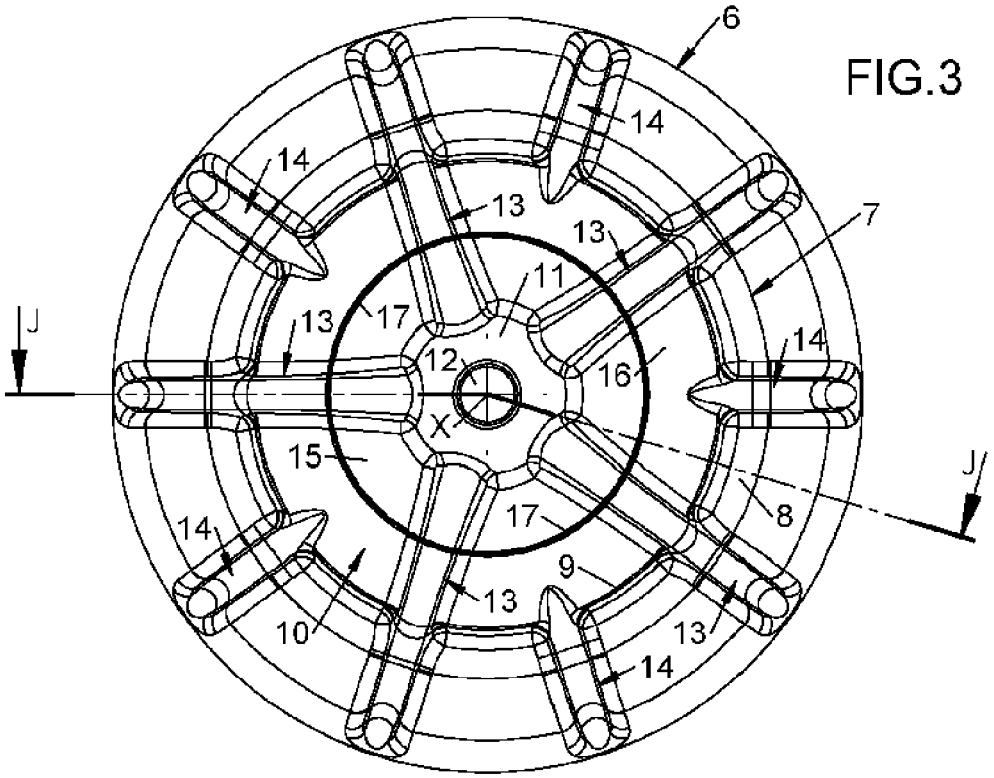
FIG. 3 is a bottom view of the container.

According to a preferred embodiment, the body 6 is further provided with a series of intermediate reinforcing grooves 14 situated between the principal grooves 13, and which extend locally over the seat 7 that they thus contribute to rigidifying. As represented in FIGS. 2 and 3, the intermediate ribs of 14 extend towards the exterior beyond the seat 7, rising laterally over a lower part of the body 5, like the principal grooves 13. It can also be seen in FIGS. 2 and 3 that the intermediate ribs 14 overlap the cheek 9 but are interrupted at the periphery of the arch 10.

Figure 4:
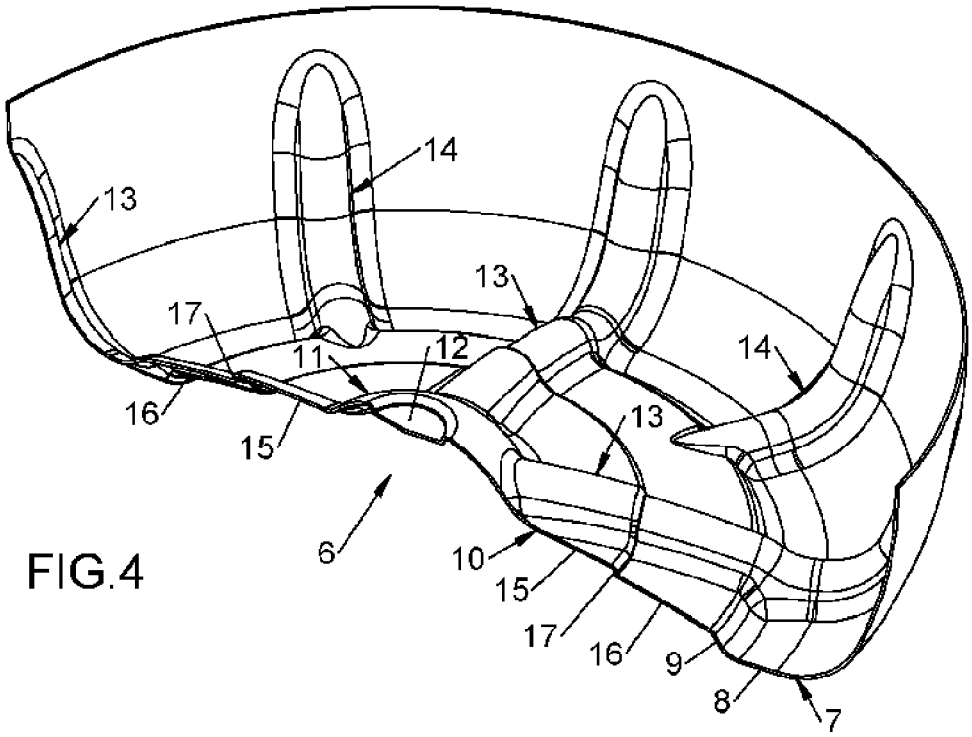
FIG. 4 is a view in perspective, in central cross section, of the container of FIG. 3.
Figure 5:
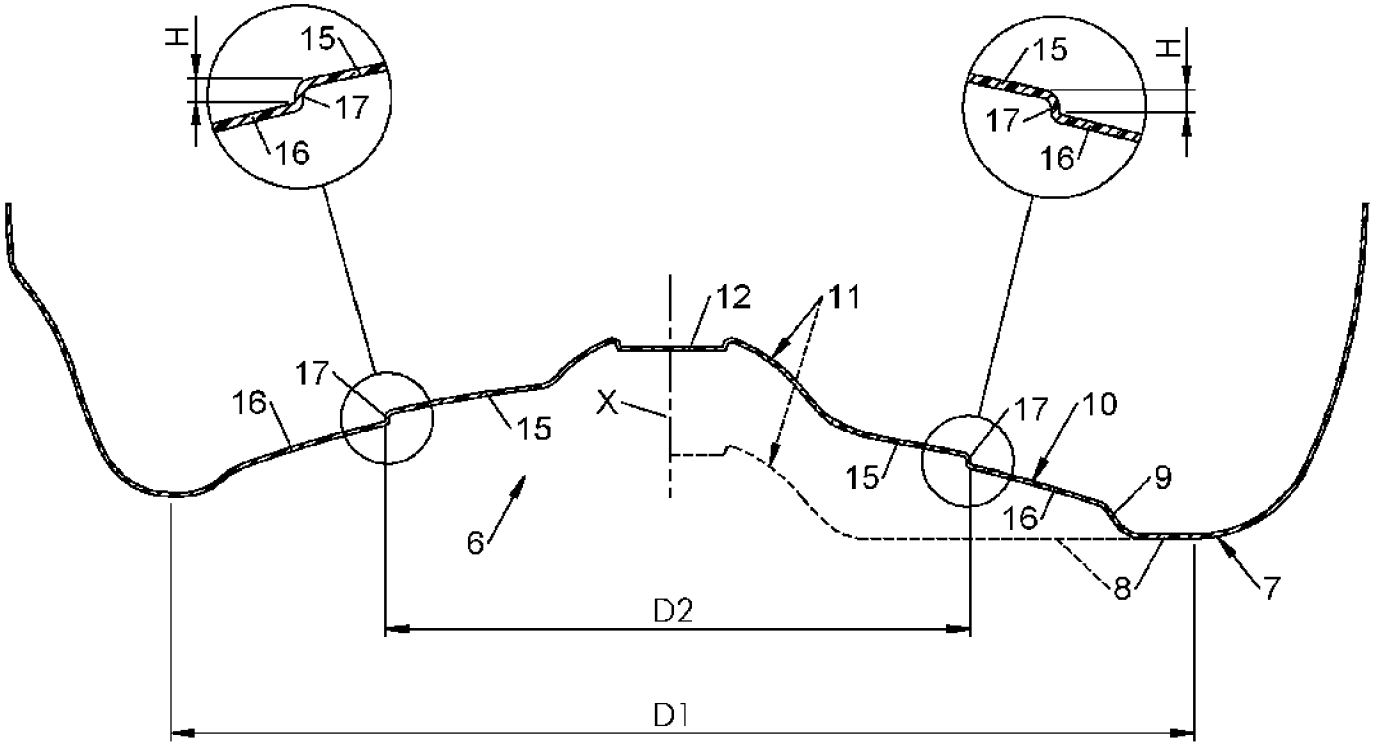
FIG. 5 is a view in central cross section of the container of FIG. 3.

As can be seen in the Figures, and more clearly in FIGS. 2, 4 and 5, the arch 10 has two concentric regions, i.e. an annular central region 15 and encircling the central zone 11 of the bottom 6, and an annular peripheral region 16 and encircling the central region 15, separated by a step 17 which extends axially over a predetermined height H. Said step 17 is medial with respect to the arch 10, i.e. the central region 15 and the peripheral region 16 have substantially the same radial extension.

The step 17 extends continuously, i.e. it is not interrupted at the principal grooves 13 but extends to the bottom thereof.

The axial step 17 extends annularly around the central zone 11. In the embodiment represented, where the shape of the container 1 is substantially cylindrical in revolution around its axis X, the step 17 forms a ring of circular contour, the diameter of which is denoted D2. In the variance already mentioned, where the container 1 would have a polygonal contour in transverse cross-section, the step 17 would also have a polygonal contour, homothetic to the exterior contour of the container 1. D2 would then designate the diameter of the circle in which the polygonal contour of the step would be inscribed.

By the presence of the axial step 17, the central region 15, although it has a radius of curvature substantially identical to that of the peripheral region 16, is slightly raised with respect thereto, while being offset towards the interior of the container 1.

According to one embodiment, the diameter D2 of the step 17 is between 40% and 60% of the diameter D1 of the seating plane 8. In the illustrated example, the ratio D2/D1 is about 50%.

With regard to the height H of the step 17, it is substantially consistent over its contour, while advantageously falling between 0.4 mm and 1.2 mm. For a container with a capacity of 0.5 liter (which corresponds to the illustrated example), said height H falls between 0.4 mm and 0.7 mm, and is for example 0.5 mm. For a container with a capacity of 1.5 liters, the height H of the step 17 falls between 0.7 and 1.2 mm, and is for example about 1 mm.

The function of the step 17 is to maintain the stability of the container 1 under extreme conditions of pressure and/or volume, particularly when an overpressure in the container 1 is caused by an expansion of the contents and of the volume below the neck, due, for example, to exposure of the container 1 (when full) to the sun, or when the contents undergo expansion caused by solidification, due, for example, to storage of the container 1 (when full) in a freezer.

Under these conditions, the contents exert a pressure on the bottom 6 which tends to collapse it. The step 17, however, resists the complete reversal of the bottom 6 by inducing a rigidification of the arch 10 in its medial region, and by limiting the deformation of the arch 10 so as to enlarge the seat 7 (as suggested by the dashed lines in FIG. 5) towards the center of the bottom 6. At the most, the bottom 6 actually undergoes a reversal, but in a controlled way, the central region 15 of the arch 10 then forming a secondary seat by which the container 1 can rest stably on a support surface.

If the diameter D2 of the step 17 is too small (typically less than 40% of the diameter D1 of the seating plane 8), the secondary seating surface formed by the reversed central region 15 would be too small and the container would be unstable. If, on the contrary, the diameter D2 of the step 17 were too large (typically more than 60% of the diameter D1 of the seating plane 8), the risk of reversal of the bottom 6 would be increased, the deformation of the arch 10 less well-controlled, and the result would be instability of the container.

An axial (i.e. cylindrical) step 17 extending over a relatively low height H offers a good compromise between control of the deformation of the bottom 6 as has just been described, and a good blowability of the bottom 6.

Thus, a container 1 made of PET corresponding to the illustrated shape, with a capacity of 0.5 liter, a mass of 10 g, was able to be blown without difficulty at a pressure of 19 bars, the final container 1 filled with flat water offering good mechanical performance under the aforementioned extreme conditions (exposure to sunlight at 50° C. and freezing at −18° C.): the deformation of the bottom 6 remains controlled, the central region 15 of the arch 10 forming a secondary seat enabling the container 1 resting on a horizontal surface to preserve good stability.

An increase of the height H of the step 17 could increase the rigidity of the bottom 6, but at the same time would result in a decrease of its blowability at the step 17, unless they were tapered, which would then decrease the rigidity of the bottom 6.

The container 1 provided with this bottom 6 offers a good compromise between the mechanical performance (i.e. the ability of the container 1 to resist deformations and, when they occur, to undergo them in a way that is controlled) and blowability (i.e. the ability of the container 1 to be formed by blowing).

The invention claimed is:

1. A container made of plastic, provided with a body and a bottom extending from an end of the body, the bottom comprising:

a peripheral seat defining a seating plane;

a central zone at an inner area of the bottom surrounding a pellet and corresponding to a zone of injection of the material of a preform used to produce the container;

a concave arch extending from the central zone to the peripheral seat;

a series of principal reinforcing grooves extending radially from the central zone to at least the peripheral seat, wherein the concave arch has two concentric regions, including a central region and a peripheral region, separated by a median axial step that extends annularly continuously around the central zone, so that the central region is raised with respect to the peripheral region, and a diameter of the step is between 40% and 60% of a diameter of the seating plane.

2. The container according to claim 1, wherein the diameter of the step is about 50% of the diameter of the seating plane.

3. The container according to claim 1, wherein the series of principal reinforcing grooves extend radially beyond the peripheral seat.

4. The container according to claim 1, wherein the bottom comprises a series of intermediate reinforcing grooves, extending locally over the peripheral seat.

5. The container according to claim 1, wherein the step has a height of between 0.4 and 1.2 mm in an axial direction of the container.

6. The container according to claim 5, wherein the container has a capacity of 0.5 liter and the step has a height of between 0.4 and 0.7 mm in the axial direction of the container.

7. The container according to claim 6, wherein the step has a height of about 0.5 mm in the axial direction of the container.

8. The container according to claim 5, wherein the container has a capacity of 1.5 liters and the step has a height of between 0.7 and 1.2 mm in an axial direction of the container.

9. The container according to claim 8, wherein the step has a height of about 1 mm in an axial direction of the container.

10. A container comprising:

a body; and a bottom at an end of the body, the bottom comprising:

a peripheral seat;

a central zone surrounding a pellet and corresponding to a zone of injection of the material of a preform used to produce the container; and a concave arch extending from the peripheral seat to the central zone, wherein the concave arch includes at least a central region and a peripheral region separated by a median axial step which extends annularly around the bottom, the central region and the peripheral region are separate regions, the central region of the concave arch is axially higher than the peripheral region of the concave arch, and a diameter of the median axial step is between 40% and 60% of a diameter of the peripheral seat.

11. The container according to claim 10, further comprising:

a reinforcing groove extending radially from the central region to at least the peripheral seat.

* * * * *